US005405678A

United States Patent [19]

Bilodeau

[11] Patent Number: 5,405,678

[45] Date of Patent: Apr. 11, 1995

[54] INK JET RECORDING SHEET

[75] Inventor: Wayne L. Bilodeau, Farmington, Me.

[73] Assignee: Otis Specialty Papers Inc., Jay, Me.

[21] Appl. No.: 172,392

[22] Filed: Dec. 23, 1993

Related U.S. Application Data

[63] Continuation-in-part of Ser. No. 57,822, May 7, 1993, abandoned.

[51] Int. Cl.[6] ..... B41M 3/00; B41M 5/00

[52] U.S. Cl. ..... 428/211; 427/146; 427/288; 427/391; 428/195; 428/328; 428/511; 428/514

[58] Field of Search ..... 427/146, 288, 372.2, 427/384, 391; 428/195, 328, 331, 507, 514, 211, 511

[56] References Cited

U.S. PATENT DOCUMENTS 4,642,247 2/1987 Mouri et al. ..... 428/195

*Primary Examiner*—Pamela R. Schwartz

*Attorney, Agent, or Firm*—Burns, Doane, Swecker and Mathis

[57] ABSTRACT

Provided is an ink jet paper comprised of a substrate coated with a composition comprised of a latex film which has not been fully coalesced. The coating on the ink jet recording sheet is obtained by coating a composition comprised of a hydrophobic polymer latex onto the sheet, and then drying at a temperature below the film forming temperature of the polymer latex. As a result, the latex does not coalesce or form a smooth, continuous film.

24 Claims, No Drawings

INK JET RECORDING SHEET

CROSS REFERENCE TO RELATED APPLICATIONS

This application is a continuation-in-part of U.S. Ser. No. 08/057,822, filed May 7, 1993, now abandoned.

BACKGROUND OF THE INVENTION

The present invention relates to ink jet recording. More particularly, the present invention relates to a coated sheet, and in particular a coated paper, which is suitable as a recording sheet for use in an ink jet recording process.

Ink jet recording systems are now widely known. They generate almost no noise and can easily perform multicolor recording. Generally, the recording sheets used in ink jet recording processes today are coated sheets, and in particular coated papers. Typical coatings applied to ink jet recording papers utilize high levels of small particle size silica. The use of the silica aids in absorbing ink, thereby permitting the high speed nature of the ink jet printing to occur. The ink jet inks are mostly water based with water soluble dyes providing the print color.

The silica used in ink jet recording papers, generally have surface areas above 200 $m^2/g$ as measured by the BET method. See, for example, U.S. Pat. No. 4,478,910, which discloses an ink jet recording paper comprising a base sheet with a specific sizing degree, a coating layer comprising a water soluble polymeric binder and a particular fine silica particle. The use of such silica, however, is difficult to formulate into coating formulations due to its affect on rheology. Typical silica coating formulations generally comprise from 15 to 50% by weight solids.

Furthermore, although silica systems provide excellent ink jet recording materials, they do have limitations in terms of dusting due to their high binder demand. They also generally provide a matte finish instead of glossy surfaces, and current systems produce limited dot size. Dot size will need to be reduced with higher resolution printers becoming more available, which is a trend in the graphic arts industry.

Coated ink jet papers employing various polymers are also known.

For example, in U.S. Pat. No. 4,481,244, an ink jet recording material is described which comprises a substrate and a coating layer formed of a polymer having both hydrophilic segments and hydrophobic segments. Such a polymer is prepared by addition-polymerizable vinylic monomers. Hydrophilic segments comprising carboxylic or sulfur groups, or ester groups thereof are introduced into the polymer by using a prescribed amount of an alpha, beta unsaturated monomer such as acrylic acid, methacrylic acid, crotonic acid, itaconic acid, maleic acid, fumaric acid, vinylsulfonic acid, sulfoethylmethacrylate, sulfopropylmethacrylate or sulfonated vinyl naphthalene. Monomers most suitable for introducing the hydrophobic segments are styrene, styrene derivatives, vinyl naphthalene, vinyl naphthalene derivatives and esters derived from aliphatic $C_8$–$C_{18}$ aliphatic alcohols and alpha, beta ethylenic unsaturated carboxylic acids. Once the polymer has been prepared from a combination of the required monomers, it is necessary to form a salt of the polymer in order to make the polymer soluble or colloidally dispersible in the medium of the coating material. Substances which can combine with the polymer to form the salt include alkali metals such as sodium and potassium, as well as aliphatic amines.

U.S. Pat. No. 4,425,405 discloses an ink jet recording sheet comprising a paper support and a coating composition which comprises an aqueous dispersion of polyvinylpyrrolidone, vinyl pyrrolidone-vinyl acetate copolymer or a mixture thereof serving as a binder or sizing agent, and a white filler. The patent also discusses other systems known to the art which involve the use of sizing agents. Such sizing agents include oxidized starch, polyvinyl alcohol, galactomannon gum, polyacrylamide, sodium alginate, styrene-maleic acid copolymer, carboxymethyl cellulose and other cellulose derivatives, casein, soy bean protein and the like. The use of sizing additives, such as hydrophobic materials or latices, rosins and its derivatives, petroleum resins, fumaric acid, maleic acid and its derivatives, waxes, synthetic resins, fatty acids, alkyl ketene dimers and the like, are also mentioned. The use of systems comprised of a white pigment such as clay, talc, diatomaceous earth, calcium carbonate, calcium sulfate, barium sulfate, titanium oxide, zinc oxide, zinc sulfide, satin white, aluminum silicate, lithopone and the like in combination with a binder resin, such as oxidized starch, etherified starch, gelatin, casein, carboxy methyl cellulose, hydroethyl ethylcellulose, polyvinyl alcohol and SBR latex, are also briefly discussed.

U.S. Pat. No. 4,371,582 describes an ink jet recording sheet containing a basic latex polymer. As described in the examples, formulations comprised of the basic latex can be coated onto a sheet and dried to provide an ink jet recording sheet, or impregnated into the sheet to provide an ink jet recording sheet. The dyes useful with the basic latex are described as being any water-soluble dyes having at least one sulfo group in the molecule.

U.S. Pat. No. 4,496,629 relates to a recording paper characterized by comprising a substrate coated with a layer finely divided by microcracks of irregular form into numerous lamellae. The coating layer is basically comprised of a material which contains a film formable resin, and which may additionally contain one or more components selected from various surfactants and porous inorganic powders. Either water soluble resins or organic solvent soluble resins are usable. The paper quickly fixes a coloring matter of ink by capturing it with the lamellae and also quickly absorbs the solvent of the ink through the microcracks into the substrate.

U.S. Pat. No. 5,215,812 discloses a coated printing paper which comprises a paper substrate, a pigment coated layer on one or both sides of said substrate, and superposed thereon a surface layer of a thermoplastic polymeric latex having a second order transition temperature of at least 80° C. The surface layer is treated with a calendar at a temperature less than said second order transition temperature in order to prepare a high gloss layer.

The use of polymer based ink jet coatings, however, have always experienced problems with regard to ink absorptivity. Thus, immediately after recording, the dried state of ink is actually unstable and this results in inherent problems when sheets just after recording are contacted under pressure or stacked upon high speed recording. The result is that the ink migrates or is scratched upon transfer of the still unstable imaged sheets on the roll of the recording apparatus. This is one of the reasons that silica systems are primarily used today. Nevertheless, as discussed above, silica systems also have limitations.

It is therefore an object of the present invention to provide a system which avoids the problems of using silica.

Another object of the present invention is to provide a system based upon a polymer which exhibits excellent affinity for ink jet inks.

It is yet another object of the present invention to provide an ink jet paper comprised of high binder levels resulting in improved coating strength.

Still another object of the present invention is to provide an ink jet recording paper which exhibits high definition, contrast, improved dot size and improved gloss.

These and other objects and aspects of the present invention will become apparent to one skilled in the art upon a review of the following description and the claims appended hereto.

SUMMARY OF THE INVENTION

In accordance with the foregoing objectives, the present invention provides one with an ink jet paper comprised of a substrate coated with a composition comprised of a hydrophobic polymeric latex which has not been fully coalesced. The coating on the ink jet recording sheet is obtained by coating a composition comprised of a hydrophobic polymer latex onto the sheet, and then drying at a temperature below the film forming temperature of the latex. As a result, the latex does not form a smooth film. Rather, the small particles in the latex remain intact to provide a high surface area.

In another embodiment of the present invention, there is provided a process for preparing an ink jet recording sheet which comprises first coating a hydrophobic polymeric latex containing formulation on a base sheet and then drying the formulation at a temperature below the minimum film forming temperature of the polymer latex.

In a most preferred embodiment, the latex is comprised of an acrylic or vinyl chloride hydrophobic polymer latex, and the minimum film forming temperature for the polymer latex is preferably in the range of from 30° to 100° C., and most preferably in the range of from about 60°–80° C.

DETAILED DESCRIPTION OF THE PREFERRED EMBODIMENTS

The ink jet recording sheet of the present invention is comprised of a base coated with a hydrophobic polymeric latex film which has not been fully coalesced into a smooth film. This coating is achieved by adding the hydrophobic polymeric latex to a coating formulation, applying it to the base, and then drying the coating at a temperature below the minimum film forming temperature of the polymeric latex. By minimum film forming temperature is meant the lowest temperature at which the particles melt and coalesce sufficiently to form a smooth continuous film. Below the minimum film forming temperature, the polymer particles do not fully coalesce, so that a smooth, continuous film is not achieved. Therefore, keeping the drying temperature below the minimum film forming temperature of the hydrophobic polymer latex, a smooth film is not created as the particles of the polymer latex are not allowed to melt, coalesce and form a smooth film. As a result, it is believed that the small particles of the latex remain intact and a film coating is created which is porous and has a high surface area.

The polymeric latex must also be hydrophobic to realize the most beneficial advantages of the present invention. By hydrophobic is meant, for the purposes of the present invention, that the acid number of the polymeric latex as determined by the acid value test ASTM D1417 is less than 10. It is preferred that the acid number of the polymer latex is less than 3, more preferably less than 2, with an acid number of about 0 being yet the most preferred. The acid number value of the polymeric latex reflects the hydrophilicity of the latex. If a low acid number value is achieved for the latex, then the latex will be hydrophobic. In other words, the acid number defines the degree of hydrophobicity of the latex. It has been found that the use of polymer latexes in the ink jet coatings which have a high acid number, and are not hydrophobic, do not provide the print quality realized by the practice of the present invention.

The base upon which the coating is applied can be any conventional substrate, but is preferably a paper base. Ink jet papers are the primary focus of the present invention. However, applicability is also found for substrates other than paper that are useful in today's ink jet printing processes, such as cloth, fabrics, plastic films, glass, metallic plates, etc.

The ink jet coating formulation can vary greatly in weight percent of solids, but it is generally preferred to have as much solids content as practical in order to avoid having to remove large amounts of aqueous solvent during drying. Preferably, the coating formulation comprises at least 30 weight percent solids, and more preferably from 40–65 weight percent solids, and most preferably comprises about 45%–55% solids by weight. This is quite high compared to conventional silica systems which generally employ a much lower percentage of weight in the coating formulation. This large percentage of solids in the coating formulation provides flexibility for a number of coating processes typical of most paper mills or converters. Thus, the coating formulation can be applied by any conventional coating method quite easily.

The hydrophobic polymer latex employed in the coating formulation is employed in a major amount. Preferably the polymer latex is employed in an amount which comprises at least about 40% by weight of the solids in the formulation (based on dry weight), more preferably at least 60% by weight, and most preferably at least 70% by weight, e.g., from 70–90% by weight. Generally, during drying, the major liquid portion of the coating formulation is removed. The resulting coating will generally contain, therefore, the polymer of the latex in an amount comprising at least 35% by volume of the coating, more preferably at least 55% by volume, and most preferably at least 65% by volume, e.g., from 65–85% by volume.

Another advantage of the polymer latexes employed being of a hydrophobic nature is that it has been found that the hydrophobic polymer latexes have a greater affinity for the aqueous based inks employed in ink jet printing today. Among the best aqueous hydrophobic polymeric latexes employed are those based upon acrylic polymers, as well as vinyl chloride polymers. The polymers can be homopolymers or copolymers. The polymers can also contain functional groups, e.g., the polymers can be carboxylated. The use of hydrophobic acrylic polymer latexes, such as aqueous latexes of polymers or copolymers of acrylic acid, methacrylic acid, esters of the two foregoing acids, and acrylonitrile, is most preferred. Such latexes are commercially available, for example, from BF Goodrich under the HYCAR trademarks, e.g., HYCAR 26256 and HYCAR 26237 are two examples. Preferred useful polymer latexes have been employed which exhibit a minimum film forming temperature in the range of from about 30° to 100° C., and more preferably in the range of from about 40°-80° C., e.g., from 40°-60° C., and most preferably in the range of from about 60°-80° C. The preferred polymer latexes also generally have an average particle size of about 180 nm or less, in order to insure sufficient surface area to obtain excellent print quality.

The particular choice of any type of hydrophobic polymer latex depends on the color retention and processing temperatures to be used. When high temperatures are to be used in the processing, the choice of a very hard latex would be best since technically they have minimum film formation temperatures that are also very high. The modulus of the polymer is not as important as the minimum film formation temperature and the hydrophobicity.

The coating formulation can generally also contain other polymers besides that of the latex. It has been found that a latex upon drying can result in a film with large cracks. The incorporation of small amounts of an elastomeric or soft polymer, i.e., a polymer which exhibits a $T_g$ typically of about 15° C. or lower, can reduce or eliminate the level of cracking on the surface. The preferred elastomeric polymers used to date are those available from B. F. Goodrich under the trademark HYSTRETCH V-60. The preferred soft polymers are available under the trademark EMULSION E-940 by Rohm and Haas as well as POLYCO 2311 and RES 3103, also available from Rohm and Haas. The amount of elastomeric or soft polymer used in the coating formulation can vary, and is preferably in the range of from about 1-20 weight percent, and more preferably in the range of from about 3-10 weight percent.

One of the advantages of the present invention is that the use of silica in the coating can be minimized, or even eliminated totally. By reducing or even eliminating the amount of silica used, one can overcome the problems of dusting, matte finishes instead of glossy surfaces, and limited dot size. The present invention, therefore, provides an ink jet recording medium which provides high definition, good contrast, improved dot size and improved gloss.

While silica can be totally avoided, some small amount of a mineral pigment can be included in the formulation, generally as a filler only, in lesser amounts, such as about 40% by weight or less, or more preferably about 20% by weight or less, e.g., in the range of from about 15-20 weight percent (dry weight). For example, a synthetic aluminum silicate having a surface area of only about 100 $m^2/g$, can be used as a suitable filler, and not as a functional ingredient such as in a conventional silica system. Other suitable fillers which can be used include clay, talc, calcium carbonate, calcium sulfate, plastic pigments, calcium silicate, diatomaceous earth, magnesium silicate, tara abla, activated clay, magnesium oxide, magnesium carbonate and aluminum hydroxide. Aside from these, fillers which are ordinarily employed in the paper making industry such as titanium oxide, satin white, zinc oxide and the like may be usable as well.

The ink jet formulations can also contain other conventional additives, in small amounts, such as defoamers, surface active agents, dyes, ultraviolet absorbents, pigment dispersants, mold inhibitors, water resisting agents, etc.

The ink jet formulation is applied to the base in amounts generally ranging from 2 to 8 pounds per 3000 square feet, depending on the printer that will be used in ink jet recording. One of the advantages of the present invention is that the formulation can be readily applied using conventional large scale paper mill equipment, as well as specialized smaller scale coating equipment. Therefore, substantial advantages can be realized in economies of scale.

The amount of formulation applied depends upon the desired surface of the coating formulation on the base, which needs to be adjusted for varying ink volumes of the various printers available. Once applied, the coating is then dried so as not to cause extensive latex film coalescing, with the result being a high quality ink jet recording sheet with the capacity to produce sheets with reduced dot gain if necessary, and which affords glossy prints. This surface can be further increased in gloss by light calendaring, if desired. However, it is important that the calendaring not be such as to effect the functional ability of the coating formulation of the present invention. It is important that the small particles of the latex remain intact and that the coating remains porous and has a high surface area. For this reason, sheets which have not been calendared are often preferred.

The invention will be illustrated in greater detail by the following specific examples. It is understood that these examples are given by way of illustration and are not meant to limit the disclosure of the claims to follow. All percentages in the examples and elsewhere in the specification are by weight unless otherwise specified.

EXAMPLE I

The following formulation was prepared:

| Component | Weight Percent |
|---|---|
| Alcosperse 149 - dispersant | 3% |
| BF Goodrich HYCAR 26256 - aqueous acrylic latex ($T_g$ of 45° C.) | 41.5% |
| Hydrocarb 90 - calcium carbonate filler | 32.0% |
| Polyco 2311 - vinyl acrylic soft polymer | 18.0% |
| Ludox CLX - colloidal silica | 4.0% |
| TT 935 Thickener - thickener | 1.3% |
| Tinopal PT O.B. - optical brightener | 0.2% |

The formulation contained 45 percent by weight solids overall and had a Brookfield viscosity of 2560 cps, measured using a No. 4 spindle at 20 rpm. It was coated using a #9 wire round rod into a base paper sheet developed for thermal transfer printing. The coat weight was in the range of 4-5 lbs/3000 sq. ft. The coated formulation was then dried using a blow gun so that full coalescing of the polymer particles was not achieved. (If full coalescing is achieved, the paper would not be printable).

Upon imaging with a Hewlett Packard ink jet color printer, a high quality image is was achieved with good dot circularity, reduced dot gain and a high gloss surface.

EXAMPLE II

A formulation was prepared using the following solid components:

| Component | Weight Percent |
|---|---|
| Alcosperse 149 - dispersant | 3% |
| BF Goodrich HYCAR 26315 - aqueous acrylic latex ($T_g$ of 55° C.) | 41.5% |
| Hydrocarb 90 - calcium carbonate pigment | 32.0% |
| Polyco 2311 - vinyl acrylic soft latex | 18.0% |
| Ludox CLX - colloidal silica | 4.0% |
| thickener | 1.5% |

The aqueous formulation contained about 45% by weight solids and was coated onto a paper base sheet developed for thermal transfer printing and dried as described in Example 1.

The coated ink jet printer was then imaged using a Hewlett Packard color ink jet printer. The resulting image was a high quality image with a high gloss finish.

EXAMPLE III

A formulation was prepared using the following solid components:

| Component | By Weight | Available From |
|---|---|---|
| Alcosperse 149 - dispersant | 5.0% | Alco |
| P820 Silicate - aluminum silicate | 15% | Degussa |
| DF-75 Defoamer | .1% | Air Products |
| Hycar 26256 - aqueous acrylic latex ($T_g$ of 45° C.) | 72.9% | BF Goodrich |
| HyStretch V-60 - elastomeric polymer | 3.0% | BF Goodrich |
| Emulsion E-940 - acrylic soft polymer | 3.0% | Rohm & Haas |
| thickener | .8% | Hercules |
| Tinopal PT - optical brightener | .2% | Ciba-Geigy |

The aqueous formulation contained about 45 percent by weight solids and had a Brookfield viscosity of 2250 cps, measured using a No. 4 spindle at 20 rpm. The formulation was coated onto a paper base sheet developed for thermal transfer printing and dried as described in Example I.

Three sheets of the coated ink jet paper were then imaged, respectively, with a Hewlett Packard Paint Jet printer, a Hewlett Packard Desk Jet 550C printer, and a Canon BJC-800 ink jet printer. The resulting image was a high quality image with a high gloss finish, good, quick drying characteristics, good dot circularity and generally good dot gain.

EXAMPLE IV

An aqueous formulation was made using the following solids:

| Component | Weight Percent |
|---|---|
| Acrylic latex - BF Goodrich HYCAR 26315 ($T_g$ of 55° C.) | 39 |
| Vinyl chloride polymer latex - Air Products AIRFLEX 4530 ($T_g$ of 30° C.) | 16 |
| Vinyl acrylic polymer - Rohm and Haas POLYCO 2311 ($T_g$ of 12° C.) | 15 |
| Silica - Degussa AEROSIL 380 | 10 |
| Calcium Carbonate - Omya HYDROCARB 90 | 20 |

The coating was formulated at 35% by weight solids and coated using a #3 rod onto a base sheet that was coated with a coating comprised of 50% calcined clay and 50% ethylated starch. The ink jet coating was applied at a coating weight of about 2.5–3.0 lbs/3000 sq. ft. The coating was dried as described in Example I.

The coated ink jet paper was then imaged with a Hewlett Packard Paint Jet printer. The resulting image was generally a high quality image with a high gloss finish.

EXAMPLE V

An aqueous formulation was made using the following solids:

| Component | Weight Percent |
|---|---|
| Acrylic latex - BF Goodrich HYCAR 26315 ($T_g$ of 55° C.) | 50 |
| Vinyl chloride polymer latex - Air Products AIRFLEX 4530 ($T_g$ of 30° C.) | 10 |
| Vinyl acrylic polymer - Rohm and Haas POLYCO 2311 ($T_g$ of 12° C.) | 15 |
| Silica - Degussa AEROSIL 380 | 10 |
| Calcium carbonate - Omya HYDROCARB 90 | 20 |

The coating was formulated, coated and dried as described in Example IV.

The coated ink jet paper was then imaged with a Hewlett Packard Paint Jet printer. The resulting image was generally a high quality image with a high gloss finish.

EXAMPLE VI

An aqueous formulation was made using the following amount of solid components:

| Component | Weight Percent |
|---|---|
| Acrylic latex - BF Goodrich HYCAR 26315 ($T_g$ of 55° C.) | 42 |
| Vinyl chloride polymer latex - Air Products AIRFLEX 4530 ($T_g$ of 30° C.) | 14 |
| Vinyl acrylic polymer - Rohm and Haas POLYCO 2311 ($T_g$ of 12° C.) | 14 |
| Silica - Degussa AEROSIL 380 | 10 |
| Calcium Carbonate - Omya HYDROCARB 90 | 20 |

The coating was formulated, coated and dried as described in Example IV.

The coated ink jet paper was then imaged with a Hewlett Packard Paint Jet printer. The resulting image was generally a high quality image with a high gloss finish.

EXAMPLE VII

A coated base paper (A) was made beginning with a base stock comprised of 30% softwood northern kraft, 50% eucalyptus and 20% broke. The base stock also included 10% on fiber of precipitated $CaCO_3$. A coating comprised of 19.5% ethylated starch, 82% calcined clay and 0.5% thickener was applied to the functional side of the paper base at 3.5 lbs/3000 sq. ft. A coating of 80.9% ethylated starch, 15.8% calcined clay, 2.5% of a sodium alginate thickener and 0.8% of a glyoxal crosslinker was applied to the wire side of the base stock at 1.5 lbs/3000 sq. ft.

A second base paper (B) was made as above, except that the coating for the functional side comprised 2% of a dispersant, 30.1% of an aluminum trihydrate pigment, 54.1% of calcined clay, 11.0% of a styrene-butadiene latex binder, 0.8% of a polyacrylate thickener and 2% of an aluminum zirconium carbonate crosslinker (AZC), with added ammonia to a pH of 8.5.

Both base paper A and B were lightly calendared to a Sheffield smoothness of about 40 cc/min.

Ink jet coating formulations were prepared employing water, an acrylic copolymer latex available from BF Goodrich under the trademark HYCAR 26237, a polyquaternary compound available from Cytek Industries under the trademark CYPRO 515, a hydrophobic, soft binder polymer available from Rohm & Haas under the trademark Emulsion E940, an optical brightener and a thickener. Fifteen different formulations were made using the following amounts of the foregoing components:

| Formulation | CYPRO 515 | HYCAR 26237 | EMUL E940 | Opt. Bright | Thickener | Water |
|---|---|---|---|---|---|---|
| 1 | 11.83 | 80.81 | 6.76 | 0.25 | 0.11 | 0.24 |
| 2 | 8.11 | 83.14 | 8.11 | 0.25 | 0.11 | 0.28 |
| 3 | 14.20 | 77.15 | 8.11 | 0.25 | 0.11 | 0.18 |
| 4 | 8.11 | 88.13 | 3.04 | 0.25 | 0.11 | 0.36 |
| 5 | 14.20 | 82.14 | 3.04 | 0.25 | 0.11 | 0.26 |
| 6 | 8.11 | 88.13 | 3.04 | 0.25 | 0.11 | 0.36 |
| 7 | 11.15 | 82.64 | 5.58 | 0.25 | 0.11 | 0.27 |
| 8 | 14.20 | 77.15 | 8.11 | 0.25 | 0.11 | 0.18 |
| 9 | 8.11 | 83.14 | 8.11 | 0.25 | 0.11 | 0.28 |
| 10 | 14.20 | 82.14 | 3.04 | 0.25 | 0.11 | 0.26 |
| 11 | 14.20 | 79.64 | 5.58 | 0.25 | 0.11 | 0.22 |
| 12 | 11.15 | 80.14 | 8.11 | 0.25 | 0.11 | 0.23 |
| 13 | 8.11 | 85.63 | 5.58 | 0.25 | 0.11 | 0.32 |
| 14 | 11.15 | 85.13 | 3.04 | 0.25 | 0.11 | 0.31 |
| 15 | 8.11 | 85.63 | 5.58 | 0.25 | 0.11 | 0.32 |

Each formulation was a 100 g mixture at 50.7 wt % solids. The various formulations were allowed to mix for 10 minutes in order to disperse the thickener. The Brookfield viscosity was measured before coating the formulations using a #4 spindle at 20 rpm. The measured viscosities are noted in the Table below.

The formulations were each coated on a sheet of basepaper A and a sheet of basepaper B using a #3 rod. An HP Desk Jet 550C printer was used to print each of the coated sheets under standard TAPPI conditions of 50% relative humidity. The drying times for the coated sheets were extremely short.

The color density of the black solid areas was measured using a Macbeth TR927 Densitometer, using the green filter. The values in Table 1 below reflect the average value of 5 readings.

TABLE 1

| Formulation | Viscosity, cps | Color Density Base A | Color Density Base B |
|---|---|---|---|
| 1 | 720 | 1.08 | 1.07 |
| 2 | 1450 | 1.14 | 1.07 |
| 3 | 450 | 1.02 | 1.06 |
| 4 | 1450 | 1.11 | 1.08 |
| 5 | 470 | 0.98 | 1.05 |
| 6 | 1720 | 1.11 | 1.09 |
| 7 | 660 | 1.07 | 1.04 |
| 8 | 480 | 1.02 | 1.02 |

TABLE 1-continued

| Formulation | Viscosity, cps | Color Density Base A | Color Density Base B |
|---|---|---|---|
| 9 | 1170 | 1.09 | 1.04 |
| 10 | 530 | 1.04 | 1.11 |
| 11 | 450 | 1.04 | 1.07 |
| 12 | 720 | 1.05 | 1.06 |
| 13 | 2320 | 1.12 | 1.08 |
| 14 | 880 | 1.03 | 1.07 |
| 15 | 1430 | 1.12 | 1.07 |

The foregoing results demonstrates the excellent color print quality one can generally obtain using the present invention. The bleed and resolution also looked quite good for all of the prints.

EXAMPLE VIII

The base paper B of Example VII was made, except that the paper was calendared using a steel/steel calender rolls to a Sheffield smoothness of 30–35 cc/min. The paper base was then coated on the functional side with the following ink jet formulations:

| | |
|---|---|
| CYPRO 515 | 14% |
| Ammonia - | to pH 9 |
| HYCAR 26237 | 80.3% |
| Emulsion E940 | 5% |
| optical brightener | 0.5% |
| thickener | 0.2% |

The ink jet formulation was coated at a weight of 3.0 lbs/3000 sq. ft., with a coating solids weight of about 50 wt %.

The wire side of the base paper was coated with a curl control coating comprised of 89.2% clay, 10% of a styrene-butadiene latex binder and 0.8% of a polyacrylate thickener. The coating weight was 1.8 lbs/3000 sq. ft.

Prints were made on the sheet both in color and monochrome using an HP Desk Jet 550C printer. Prints were also made on a commercially available ink jet paper, Hewlett Packard's CX paper, for purposes of comparison. The results with respect to the color prints were good for both papers, but the monochrome results were much better for the ink jet paper of the present invention, which exhibited much less bleed and equivalent drying times.

EXAMPLE IX

This example compares the results obtained when a hydrophobic latex in accordance with the present invention is used as compared to a latex which is not hydrophobic, i.e, has a high acid number value. In this example, several different, commercially available polymer latexes were used. Each latex was coated using a wire round rod onto a base paper sheet. The coated sheet was then printed using an HP Desk Jet 550C color ink jet printer, with the prints then being evaluated objectively as being good, acceptable or not acceptable. The results for each print are recorded in Table 2 below. The acid number for each latex, as determined by the methodology of ASTM D1417, is also noted in Table 2 below.

TABLE 2

| Polymer Latex | Good Quality Print | Acceptable Print | Non-Acceptable Print | Acid # |
|---|---|---|---|---|
| Acrylic - HYCAR 26237 | X | | | Nil (0) |
| Acrylic - JONCRYL 87 | | | X | 40 |
| Acrylic - JONCRYL 130 | | | X | 150 |
| Acrylic - JONCRYL 530 | | | X | 50 |
| Acrylic - CR 763 | | X | | 3–10 |
| Unknown - GA-1087 available from BF Goodrich | | | X | 50 |
| Vinyl chloride - AIRFLEX 4530 | X | | | Nil (0) |
| Acrylic - HYCAR 26315 | X | | | <2 |
| Acrylic - HYCAR 26447 | X | | | <2 |

While the invention has been described with preferred embodiments it is to be understood that variations and modifications may be resorted to as will be apparent to those skilled in the art. Such variations and modifications are to be considered within the purview of the scope of the claims appended hereto.

What is claimed is:

1. An ink jet recording sheet comprised of a base with a coating, with the coating being comprised of a hydrophobic polymeric latex which is not fully coalesced, said hydrophobic polymeric latex exhibiting an acid value of less than 3.

2. The ink jet recording sheet of claim 1, wherein the coating has been dried below the film forming temperature of the hydrophobic polymeric latex.

3. The ink jet recording sheet of claim 2, wherein the base is paper.

4. The ink jet recording sheet of claim 1, wherein the coating is free of silica.

5. The ink jet recording sheet of claim 1, wherein the coating is comprised of aluminum silicate as a filler.

6. The ink jet recording sheet of claim 1, wherein the hydrophobic polymer latex exhibits an acid value of from 0 to about 2.

7. The ink jet recording sheet of claim 1, wherein the latex is an acrylic polymer latex.

8. The ink jet recording sheet of claim 1, wherein the latex is a vinyl chloride polymer latex.

9. The ink jet recording sheet of claim 1, wherein the coating further comprises a soft and/or elastomeric polymer.

10. The ink jet recording sheet of claim 1, wherein the polymer of the polymeric latex is a carboxylated polymer.

11. The ink jet recording sheet of claim 1, wherein the minimum film formation temperature is in the range of from about 30° to 100° C.

12. The ink jet recording sheet of claim 1, wherein the minimum film formation temperature is in the range of from about 40° to 80° C.

13. The ink jet recording sheet of claim 1, wherein the coating contains a thickener.

14. An ink jet recording paper comprised of (1) a paper base, and (2) a coating comprised of a hydrophobic polymeric latex which is not fully coalesced due to the coating being dried below the film forming temperature of the hydrophobic polymer latex, with the polymer in the latex comprising an acrylic or vinyl chloride polymer, and with the hydrophobic polymeric latex exhibiting an acid number value of less than 3.

15. The ink jet recording paper of claim 14, wherein the coating is free of silica.

16. The ink jet recording paper of claim 14, wherein the polymer in the latex is carboxylated.

17. The ink jet recording paper of claim 14, wherein the latex is an acrylic latex.

18. A process for preparing an ink jet recording sheet which comprises coating a hydrophobic polymer latex containing formulation on a base sheet, with the hydrophobic polymer latex exhibiting an acid number value of less than 3, and drying the formulation at a temperature below the minimum film formation temperature of the polymer latex.

19. The process of claim 18, wherein the base sheet is comprised of paper.

20. The process of claim 18, wherein the hydrophobic polymer latex is an acrylic or vinyl chloride polymer latex.

21. The process of claim 18, wherein the minimum film formation temperature of the polymer in the latex is in the range of from about 30° to 100° C.

22. The process of claim 18, wherein the solids content of the coating formulation is at least 30 weight percent.

23. The process of claim 18, wherein the polymer latex comprises at least about 40 weight percent of the solids content of the coating formulation.

24. The process of claim 18, wherein the polymer latex is an acrylic latex.

* * * * *